US009721739B2

(12) United States Patent
Köpf et al.

(10) Patent No.: US 9,721,739 B2
(45) Date of Patent: Aug. 1, 2017

(54) DC VOLTAGE SWITCH FOR HIGH VOLTAGE ELECTRICAL SYSTEMS

(71) Applicant: VOLKSWAGEN AG, Wolfsburg (DE)

(72) Inventors: Hendrik-Christian Köpf, Braunschweig (DE); Andreas Minke, Gifhorn (DE); Karsten Haupt, Neubrück (DE); Ernst-Dieter Wilkening, Braunschweig (DE)

(73) Assignee: Volkswagen AG (DE)

( * ) Notice: Subject to any disclaimer, the term of this patent is extended or adjusted under 35 U.S.C. 154(b) by 0 days.

(21) Appl. No.: 14/935,120

(22) Filed: Nov. 6, 2015

(65) Prior Publication Data

US 2016/0141127 A1 May 19, 2016

(30) Foreign Application Priority Data

Nov. 18, 2014 (DE) ..... 10 2014 223 529

(51) Int. Cl.

| | |
|---|---|
| ***H01H 33/74*** | (2006.01) |
| ***H01H 1/20*** | (2006.01) |
| ***H01H 9/04*** | (2006.01) |
| ***H01H 9/34*** | (2006.01) |
| ***H01H 9/52*** | (2006.01) |

(52) U.S. Cl.

CPC ..... *H01H 33/74* (2013.01); *H01H 1/20* (2013.01); *H01H 9/04* (2013.01); *H01H 9/346* (2013.01); *H01H 9/52* (2013.01); *H01H 2213/00* (2013.01)

(58) Field of Classification Search

CPC ..... H01H 33/70; H01H 33/74; H01H 1/20; H01H 9/04; H01H 9/346; H01H 9/52; H01H 2213/00

USPC ..... 218/47, 16, 30, 31; 335/201, 202

See application file for complete search history.

(56) References Cited

U.S. PATENT DOCUMENTS 4,404,442 A 9/1983 Stich et al.
5,004,874 A * 4/1991 Theisen ..... H01H 1/20 218/151

(Continued)

FOREIGN PATENT DOCUMENTS

CN 101438364 A 5/2009
DE 3541514 A1 5/1987

(Continued)

OTHER PUBLICATIONS

WO9813842 (Original doc. published Apr. 2, 1998).*
Office Action for German Patent Application No. 10 2014 223 529.4; Aug. 7, 2015.

*Primary Examiner* — Renee Luebke
*Assistant Examiner* — William Bolton
(74) *Attorney, Agent, or Firm* — Barnes & Thornburg LLP

(57) ABSTRACT

A DC voltage switch for high-voltage on-board electrical systems having a housing, at least two stationary contacts, and a moving contact, wherein, in each case, a first contact region of the stationary contacts is routed out of the housing and, in each case, a second contact region of the stationary contacts is arranged in a switching chamber of the housing with the moving contact, wherein the housing is hermetically encapsulated, wherein a cooling chamber which is separated from the switching chamber by a partition wall is arranged above the switching chamber, wherein the partition wall has at least one outlet opening and at least one inlet opening.

11 Claims, 4 Drawing Sheets

(56) References Cited

U.S. PATENT DOCUMENTS

| | | | | | |
|---|---|---|---|---|---|
| 5,322,982 | A * | 6/1994 | Leger | H01H 5/06 | 200/401 |
| 5,519,370 | A * | 5/1996 | Perreira | H01H 3/001 | 335/154 |
| 5,546,061 | A * | 8/1996 | Okabayashi | H01H 9/443 | 335/78 |
| 6,700,466 | B1 * | 3/2004 | Yamamoto | H01H 9/302 | 335/132 |
| 6,703,575 | B1 * | 3/2004 | Yamamoto | H01H 9/342 | 218/46 |
| 2009/0067191 | A1 * | 3/2009 | Faber | F21V 29/004 | 362/580 |
| 2013/0234813 | A1 * | 9/2013 | Imamura | H01H 1/66 | 335/201 |
| 2014/0166620 | A1 * | 6/2014 | Gerving | H01H 33/18 | 218/22 |

FOREIGN PATENT DOCUMENTS

| | | | | | |
|---|---|---|---|---|---|
| DE | 69018432 | T2 | | 11/1995 | |
| DE | 29617358 | U1 | | 1/1998 | |
| DE | WO9813842 | | * | 4/1998 | H01H 9/34 |
| DE | 102012112202 | A1 | | 6/2014 | |
| EP | 0176870 | A2 | | 4/1986 | |
| JP | S6178016 | A | | 4/1986 | |
| JP | H0290424 | A | | 3/1990 | |
| JP | H1196842 | A | | 4/1999 | |
| JP | 2007305468 | A | | 11/2007 | |
| JP | 2013077506 | A | | 4/2013 | |

* cited by examiner

DC VOLTAGE SWITCH FOR HIGH VOLTAGE ELECTRICAL SYSTEMS

PRIORITY CLAIM

This patent application claims priority to German Patent Application No. 10 2014 223 529.4, filed 18 Nov. 2014, the disclosure of which is incorporated herein by reference in its entirety.

SUMMARY

Illustrative embodiments relate to a DC voltage switch for high-voltage on-board electrical systems.

BACKGROUND

DC voltage switches are required, for example, in electric or hybrid vehicles to galvanically isolate different parts of a high-voltage on-board electrical system.

In contrast to alternating currents, direct currents do not have a natural current zero crossing, and for this reason the interruption of currents of this kind is associated with particular requirements. Interruption of the currents and quenching of switching arcs which occur are usually achieved by extending the length of the arc columns and/or increasing the power conversion per unit length. However, the isolating capacity of hermetically encapsulated switching devices or DC voltage switches is limited in respect of current levels and resistive/inductive time constants, wherein the limiting factor is, in particular, the thermal capacity since the electrical power in the arc has to be thermally absorbed.

Illustrative embodiments provide a DC voltage switch for high-voltage on-board electrical systems which has an improved disconnection behavior.

BRIEF DESCRIPTION OF THE DRAWINGS

Disclosed embodiments will be explained in greater detail below with reference to the drawings.

DETAILED DESCRIPTION OF THE DISCLOSED EMBODIMENTS

Figure 1:
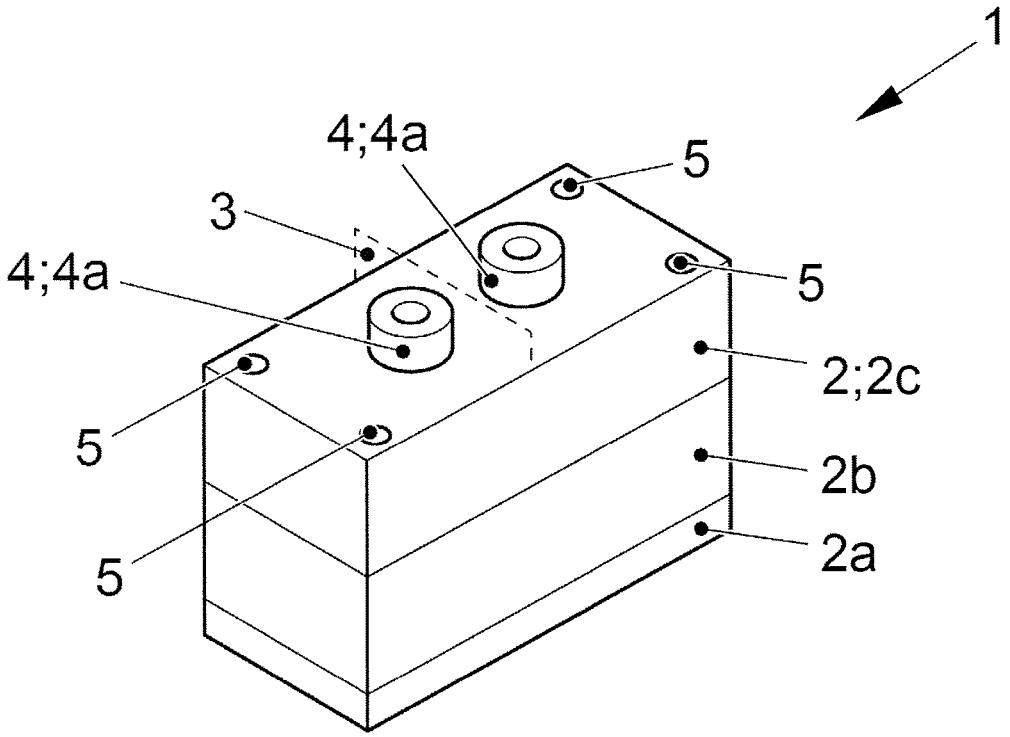
FIG. 1 shows a perspective illustration of a DC voltage switch.

The DC voltage switch for high-voltage on-board electrical systems comprises a housing, at least two stationary contacts and a moving contact, wherein in each case a first contact region of the stationary contacts is routed out of the housing. In each case a second contact region of the stationary contacts is arranged in a switching chamber of the housing with the moving contact. The housing is hermetically encapsulated in this case. A cooling chamber which is separated from the switching chamber by means of a partition wall is arranged above the switching chamber, wherein the partition wall has at least one outlet opening and one inlet opening. This has three results which have a positive influence on the switching behavior. Firstly, the thermal capacity of the DC voltage switch is increased by the additional cooling chamber. In addition, increased thermal energy discharge from the switching chamber takes place, and finally a self-excited gas flow can be produced within the switching chamber by suitable selection of the outlet and inlet openings, the gas flow pushing the arc in the direction of housing walls. This results in an improved switching behavior of the DC voltage switch. In this case, the high-voltage on-board electrical system has, for example, DC voltages of greater than 300 V.

In at least one disclosed embodiment, at least one heat sink which is thermally connected to at least one of the stationary contacts is arranged in the cooling chamber. As a result, even more heat is drawn from the hot gas and discharged from the housing by means of the stationary contact. In this case, the heat sink can also be connected to the two stationary contacts or else the heat sink is connected only to the housing by means of which the heat is then discharged. Both measures can likewise be combined. A plurality of heat sinks, optionally four heat sinks, may be provided, wherein, in this case, for example in each case two heat sinks which are half-shells are associated with a stationary contact.

In a further disclosed embodiment, the at least one outlet opening is arranged between a stationary contact and a housing inner wall. In this case, the DC voltage switch may have more than one outlet opening. For example, the DC voltage switch has four outlet openings, wherein in each case two are associated with a stationary contact. Owing to the use in the region of the housing inner wall, the outlet opening is situated in the region where the hottest gases occur. In this case, the outlet opening can be of conical shape, wherein the diameter on the side of the switching chamber is larger than the diameter on the side of the expansion chamber. The outlet opening can have the shape of a Laval nozzle for example. A Laval nozzle is a flow element having an initially convergent and then divergent cross section, wherein the transition from one part to the other part is gradual. In this case, the cross-sectional area at each point is circular. A valve can also be arranged in the outlet opening to assist directed gas flow.

In a further disclosed embodiment, the at least one inlet opening is arranged between the stationary contacts. As a result, the cooled gas flows into the arc, this assisting the expansion of the gas in the direction of the housing walls. Accordingly, it is also possible to provide more than one, for example four, inlet openings. The inlet openings can also be conical or a Laval nozzle and/or have a valve. With the conical design, the diameter on the side of the expansion chamber may be larger than the diameter on the side of the switching chamber in this case.

In a further disclosed embodiment, the gas in the housing is hydrogen or nitrogen. Hydrogen provides high energy consumption in the arc, but restricts the choice of contact materials and places relatively high requirements on the hermetic seal. Nitrogen is easier to handle and allows a relatively large degree of freedom in terms of material selection, for example silver instead of copper for the contacts.

In a further disclosed embodiment, the housing is composed of ceramic, for example aluminum nitride. In this case, the housing can also be only partially composed of ceramic, wherein the housing may comprise a uniform material. The benefit of ceramic over plastics is that ceramics are more fire-resistant, that is to say no combustion occurs owing to the arc. A further benefit is the generally better thermal conductivity in comparison to plastics. However, the housing can, in principle, also be composed of plastic.

In a further disclosed embodiment, the heat sink or the heat sinks is/are composed of copper, wherein in this case the stationary contacts may also be composed of copper. In this case, good thermal contact can be made with the heat sink and the contact by thermally conductive pastes.

As an alternative, the heat sink or the heat sinks is/are formed from a thermally conductive ceramic, which is not electrically conductive however.

As already stated, the heat sink or the heat sinks can in this case be thermally connected to the housing, wherein the heat sinks can be connected either only to the housing or else additionally to the stationary contacts, this increasing the thermal heat discharge.

In a further disclosed embodiment, an insulating plate is arranged between the first contact regions of the stationary contacts on the housing to prevent flashover.

It is also possible, in principle, to arrange permanent magnets on the housing outer walls, the permanent magnets generating an assisting magnetic field.

FIG. 1 shows, in the assembled state, a DC voltage switch 1 comprising a housing 2, two first contact regions 4*a* of two stationary contacts 4 projecting out of the housing. The housing 2 is of three-part design and has a bottom part 2*a*, a middle part 2*b* and a top part 2*c*. An insulating plate 3, which is illustrated using dashed lines, is arranged between the first contact regions 4*a*. The bottom part 2*a*, middle part 2*b* and top part 2*c* are, for example, screwed together, this being indicated by bores 5. In this case, the housing parts are connected in such a way that the housing 2 is hermetically encapsulated.

Figure 2:
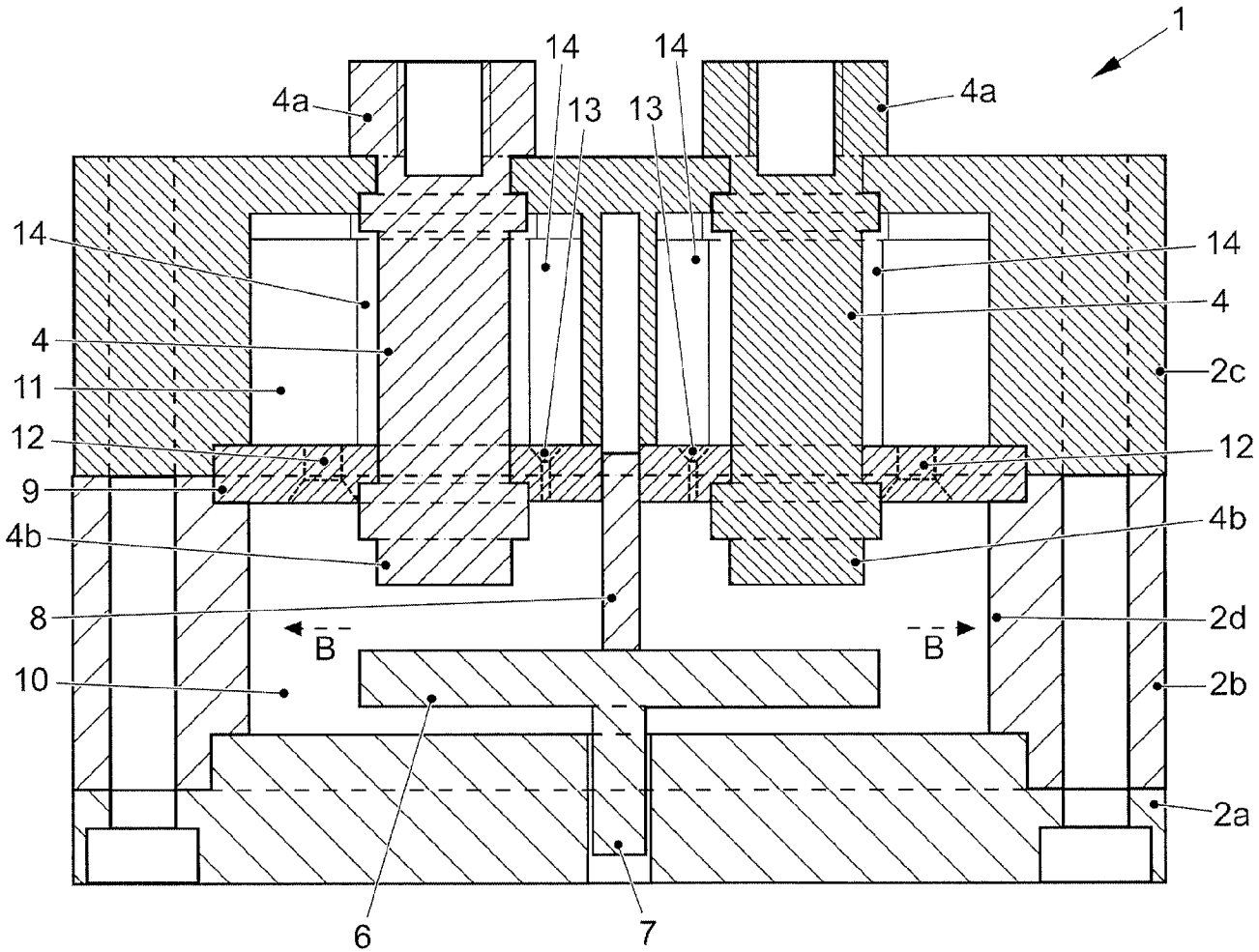
FIG. 2 shows a cross-sectional illustration of the DC voltage switch, wherein the section line runs through the two stationary contacts.
Figure 3:
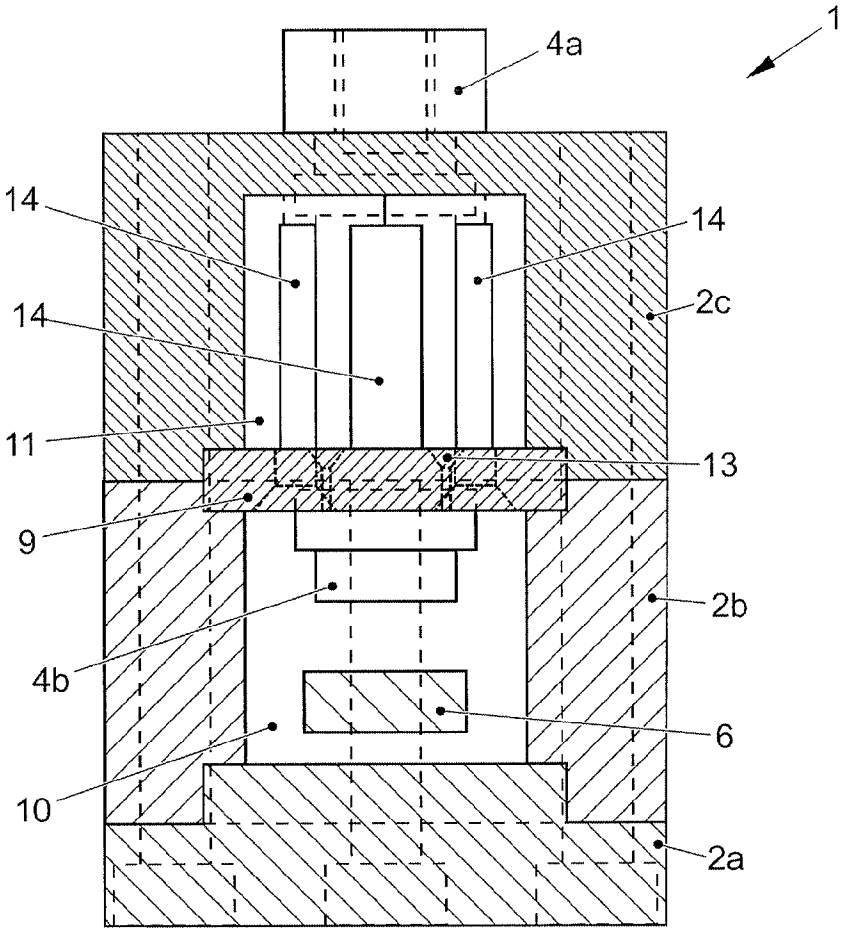
FIG. 3 shows a sectional illustration, wherein the section runs in front of a stationary contact.

As illustrated in FIGS. 2 and 3, the DC voltage switch 1 also has, in addition to the two stationary contacts 4, a moving contact 6 which is arranged below the stationary contacts 4. The moving contact 6 can be moved by a spring, not illustrated, in the direction of the stationary contacts 4, so that the moving contact 6 makes contact with second contact regions 4*b* of the stationary contacts 4. In this case, the movement of the moving contact 6 is controlled by guide elements 7, 8 in the bottom part 2*a* and top part 2*c*. A partition wall 9 is arranged above the second contact regions 4*b*. In this case, a switching chamber 10 is formed below the partition wall 9 and a cooling chamber 11 is formed above the partition wall 9. The switching chamber 10 and the cooling chamber 11 are connected to one another by means of outlet openings 12 and inlet openings 13. In this case, the outlet openings 12, which are illustrated using dashed lines, are situated between the stationary contacts 4 and the housing inner wall 2*d* and are of conical design. In this case, the outlet opening 12 is a truncated cone and merges with a cylindrical opening, wherein the relatively large diameter is situated on the side of the switching chamber 10. The inlet openings 13 are situated between the stationary contacts 4, wherein the exact position can be seen particularly clearly in FIG. 4. The inlet openings 13 are also of conical design, wherein the relatively large diameter of the inlet openings is on the side of the cooling chamber 11. As an alternative, the outlet openings 12 and/or the inlet openings 13 can be a Laval nozzle. Furthermore, heat sinks 14 which are thermally connected to the stationary contacts 4, for example by means of a thermally conductive paste, are arranged in the cooling chamber 11. In this case, the heat sinks 14 are half-shells, wherein these are slightly asymmetrical. There is a gas, for example hydrogen or nitrogen, in the switching chamber 10 and the expansion chamber 11.

If an existing contact between the moving contact 6 and the second contact regions 4*b* of the stationary contacts 4 is now opened, an arc is produced. In this case, this arc has to absorb the energy which is stored in an inductive load. Ionization of the gases results in a current flow which generates a magnetic field. This magnetic field is directed in the direction of the housing inner wall 2*d*, as illustrated using dashed lines in FIG. 2. The heated and ionized gas molecules are therefore moved in the direction of the housing inner wall 2*d*, where an excess pressure is built up, the excess pressure being reduced by outflow out of the outlet openings 12. In this case, the guide element 8 in the switching chamber 10 separates the flows to the left-hand-side and to the right-hand-side housing inner wall 2*a*, so that the flows do not have an interfering influence on one another.

In the cooling chamber 11, the hot gas flows past the heat sinks 14 and outputs heat to the heat sinks, to then flow back through the inlet openings 13 since the pressure is lower there. In this case, the return flow of the gases pushes the gases in the switching chamber 10, in addition to the magnetic field, in the direction of the housing inner wall 2*d*. The heat which is absorbed by the heat sinks 14 is then discharged from the housing 2 by means of the stationary contacts 4. Therefore, the energy is drawn from the arc and the arc is quenched.

Figure 4:
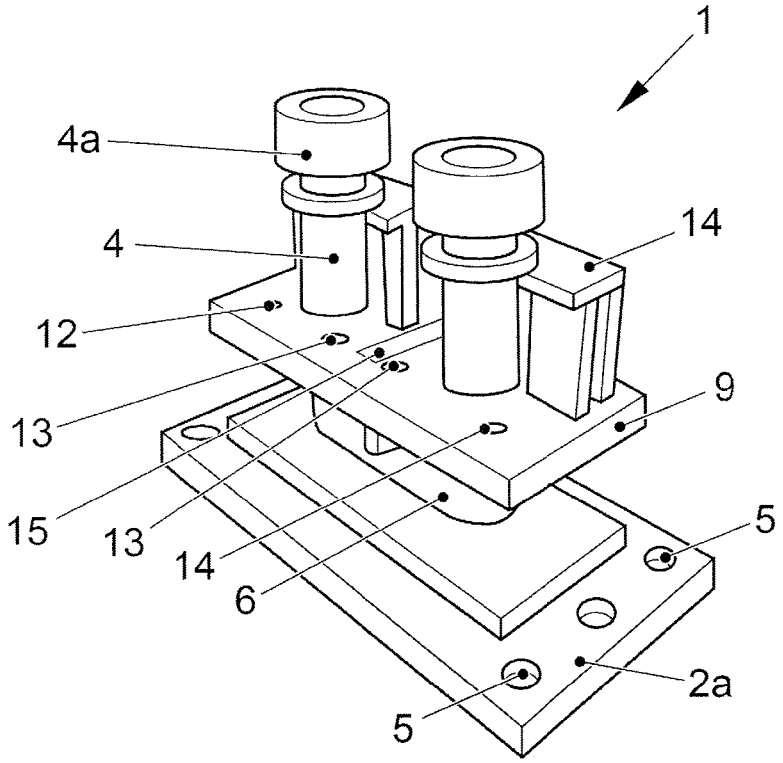
FIG. 4 shows a perspective oblique illustration of the DC voltage switch.
Figure 5:
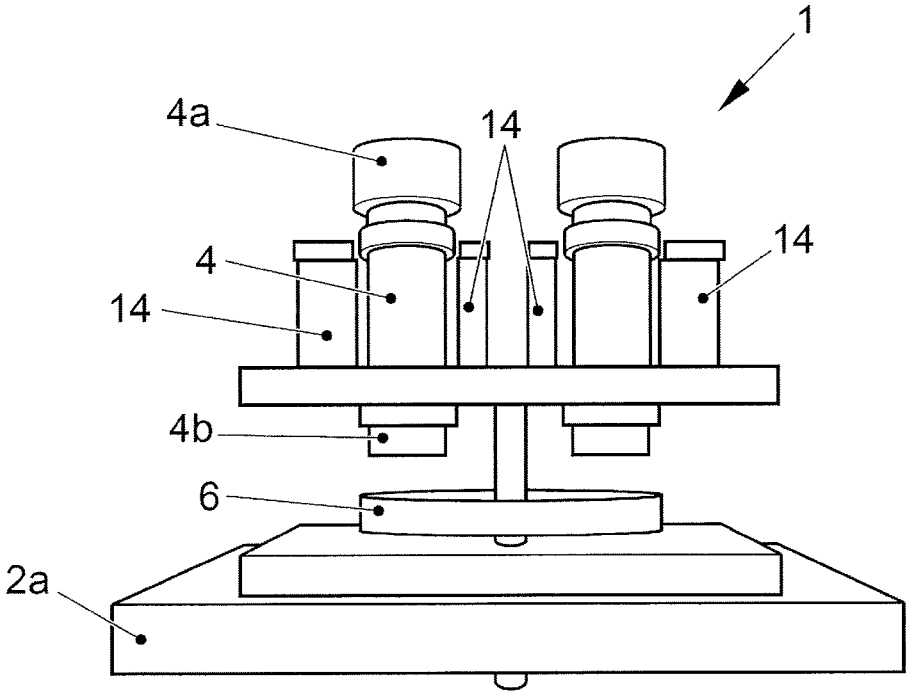
FIG. 5 shows a perspective front view of the DC voltage switch.

FIGS. 4 and 5 show the DC voltage switch 1 without the middle part 2*b* and the upper part 2*c*, wherein two heat sinks 14 have additionally been removed, so that the front outlet openings 12 and inlet openings 13 can be seen, wherein the rear outlet openings 12 and inlet openings 13 are covered by the rear heat sinks 14. Furthermore, a slot (15) for the guide element 8 can be seen. In this case, the outlet openings 12 and inlet openings 13 are situated somewhat to the front (or to the rear for those which are not visible) in relation to the stationary contacts 4. It should be noted here that the design of the heat sinks 14 in FIGS. 4 and 5 is different from the design of the heat sinks 14 in FIGS. 2 and 3.

DC voltage switches are required, for example, in electric or hybrid vehicles to galvanically isolate different parts of a high-voltage on-board electrical system.

In contrast to alternating currents, direct currents do not have a natural current zero crossing, and for this reason the interruption of currents of this kind is associated with particular requirements. Interruption of the currents and quenching of switching arcs which occur are usually achieved by extending the length of the arc columns and/or increasing the power conversion per unit length. However, the isolating capacity of hermetically encapsulated switching devices or DC voltage switches is limited in respect of current levels and resistive/inductive time constants, wherein the limiting factor is, in particular, the thermal capacity since the electrical power in the arc has to be thermally absorbed.

In the low-voltage range, this problem is often solved by the DC voltage switches not being hermetically encapsulated. As a result, the hot gases can be discharged. A solution of this kind is disclosed, for example, in DE 35 41 514 C2.

DE 690 18 432 T2 discloses a multipole low-voltage circuit breaker in an insulating-material housing which is equipped with a twin cooling apparatus for the quenching gases and which is subdivided into a plurality of internal compartments by insulating-material intermediate walls. Each compartment is associated with one of the poles and each comprises a pair of contacts which can be disconnected, an arc splitter stack for deionizing the arc which is struck when the contacts are disconnected, and also an outlet opening, which is fitted with a gas cooling apparatus, for the quenching gases. In this case, all of the outlet openings issue into a chamber which is common to the individual poles and which is connected to the surrounding medium by means of a gas discharge opening. A second cooling apparatus is inserted into the flow path of the gases between the outlet openings and the gas discharge opening.

The working paper "Schaltgerate far das Schalten von hohen Gleichspannungen in Energiesystemen and elektrisch angetriebenen Fahrzeugen [Switching devices for switching high DC voltages in energy systems and electrically driven vehicles]", VDE conference: DC voltage contact behavior and switching at U>300 VDC, Dr. Matthias Kroeker et al., Tyco Electronics, Sep. 7, 2010 discloses a DC voltage switch of the generic type for high-voltage on-board electrical systems, comprising a housing, at least two stationary contacts and a moving contact, wherein in each case a first contact region of the stationary contacts is routed out of the housing and in each case a second contact region of the stationary contacts is arranged in a switching chamber of the housing with the moving contact, wherein the housing is hermetically encapsulated. The partial arcs which occur are quenched by the power conversion of the arcs being increased beyond the driving power. For this purpose, the generated arc voltage is increased above the driving source voltage and maintained until the system current is forced to 0 A and the energy which is stored in the inductor of the electrical circuit is depleted.

The invention claimed is:

1. A DC voltage switch for high-voltage on-board electrical systems, the switch comprising:

a housing;

at least two stationary contacts; and a moving contact, wherein a first contact region of the stationary contacts is routed out of the housing and a second contact region of the stationary contacts is arranged in a switching chamber of the housing with the moving contact, wherein the housing is hermetically encapsulated, wherein a cooling chamber is separated from the switching chamber by a partition wall and arranged above the switching chamber, and wherein the partition wall has at least one outlet opening and at least one inlet opening.

2. The DC voltage switch of claim 1, further comprising at least one heat sink thermally connected to at least one of the stationary contacts and/or to the housing and is arranged in the cooling chamber.

3. The DC voltage switch of claim 2, wherein the heat sink is composed of copper.

4. The DC voltage switch of claim 2, wherein the heat sink is composed of a thermally conductive ceramic.

5. The DC voltage switch of claim 1, wherein the at least one outlet opening is arranged between one of the stationary contacts and a housing inner wall.

6. The DC voltage switch of claim 1, wherein the at least one inlet opening is arranged between the at least two stationary contacts.

7. The DC voltage switch of claim 1, wherein hydrogen or nitrogen is contained in the hermetically encapsulated housing.

8. The DC voltage switch of claim 1, wherein the housing is composed of ceramic.

9. The DC voltage switch of claim 1, wherein an insulating plate is arranged between the first contact regions of the stationary contacts on the housing.

10. A DC voltage switch for high-voltage on-board electrical systems, the switch comprising:

a housing, at least two stationary contacts, a moving contact, and a cooling chamber and switching chamber separated by a partition wall, wherein the cooling chamber is arranged above the switching chamber, the partition wall including at least one outlet opening arranged between one of the at least two stationary contacts and a housing inner wall, and at least one inlet opening arranged between the at least two stationary contacts, wherein a first contact region of the stationary contacts is routed out of the housing and a second contact region of the stationary contacts is arranged in the switching chamber of the housing with the moving contact, and the housing is hermetically encapsulated.

11. The DC voltage switch of claim 10, wherein an insulating plate is arranged between the first contact regions of the stationary contacts on the housing.

* * * * *